US007611370B2

(12) United States Patent
Ito et al.

(10) Patent No.: US 7,611,370 B2
(45) Date of Patent: Nov. 3, 2009

(54) CONNECTOR

(75) Inventors: Yoshitaka Ito, Makinohara (JP); Sumito Atsumi, Makinohara (JP); Takeshi Kazama, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/213,411

(22) Filed: Jun. 19, 2008

(65) Prior Publication Data

US 2009/0011632 A1 Jan. 8, 2009

(30) Foreign Application Priority Data

Jul. 5, 2007 (JP) ..... 2007-177136

(51) Int. Cl.
*H01R 4/50* (2006.01)

(52) U.S. Cl. ..... 439/345

(58) Field of Classification Search ..... 439/345, 439/354, 357, 358

See application file for complete search history.

(56) References Cited

U.S. PATENT DOCUMENTS 4,108,522 A * 8/1978 Favale ..... 439/357

7,374,457 B1 * 5/2008 Oksengendler et al. ..... 439/660

FOREIGN PATENT DOCUMENTS

JP 2005-259554 9/2005

* cited by examiner

*Primary Examiner*—Khiem Nguyen
(74) *Attorney, Agent, or Firm*—Edwards Angell Palmer & Dodge LLP

(57) ABSTRACT

A connector including a first connector housing; a second connector housing to be engaged with the first connector housing; a locking arm and pair of ribs for maintaining the engagement of the first and second connector housings. The locking arm includes: an arm part extending vertically from an upper wall of the first connector housing and extending in the engaging direction; and a pair of locking parts projecting toward sides of the arm part 91 in an extending direction from a tip of the arm part. The pair of ribs are extending vertically from a second hood, positioned nearer sides of the arm part than the pair of locking parts, and abuts on the pair of locking parts when the first and second connector housings are engaged with each other.

1 Claim, 14 Drawing Sheets

CONNECTOR

CROSS REFERENCE TO RELATED APPLICATIONS

This application is on the basis of Japanese Patent Application No. 2007-177136, the contents of which are hereby incorporated by reference.

BACKGROUND OF THE INVENTION

1. Field of the Invention

The present invention relates to a connector for connecting electric wires or the like.

2. Description of the Related Art

As a connector for a vehicle, FIGS. 14 and 15 show a connector 100. This connector 100 is assembled by attaching a first connector housing 104 onto a panel 102 as a component of a vehicle body having a hole 107 through which the first connector housing 104 and a second connector housing 103 are inserted in a temporary locking manner (see FIG. 14), then by engaging the second connector housing 103 with the temporarily locked first connector housing 104 (see FIG. 15) (for example, see Patent Document 1).

Further, in the connector 100, after a locking arm 109 formed on the first connector housing 104 is locked on a locking arm receiver S' formed on the second connector housing 103, the engagement between the first and second connector housings 104, 103 is maintained. The locking arm 109 includes an arm part 191 extended vertically from an outer wall 142 of the first connector housing 104, and extended in an engaging direction Z of the connector 100, and overlapped with an outer wall 134 of the second connector housing 103, and a locking part 192 projected from a tip of the arm part 191 toward the outer wall 134 in a height direction Y perpendicular to the engaging direction Z in the engaging state of the connector 100. Further, the locking arm receiver S' is a hole extending from a front wall of the outer wall 134 in the height direction Y.

As shown in FIG. 16, when the connector housings 104, 103 are moved closely to each other in the engaging direction Z, the locking part 192 abuts on the outer wall 134, the arm part 191 is bent about a base end E' thereof, and the locking part 192 is moved over the outer wall 134. When the connector housings 104, 103 are moved further closely to each other, the locking part 192 is received in the locking arm receiver S', and the locking arm 109 is locked on the locking arm receiver S'.

[Patent Document 1] Japanese Published Patent Application No. 2005-259554

Preferably, a size along the height direction Y of the connector 100, namely, a size in a bending direction of the locking arm 109 is small-sized for being mounted on various vehicles. However, as described above, in the conventional locking arm 109, the locking part 192 projecting from the tip end of the arm part 191 in the height direction Y is received in the locking arm receiver S' for locking the locking part 192. Therefore, the size along the height direction Y of the connector 100 is composed of a size for receiving a terminal, a size of thickness of the arm part 191, and a size T of a projection of the locking part 192. This results a limit for small-sizing the size in the height direction Y of the connector 100.

Further, as shown in FIG. 16, when the locking part 192 abuts on the outer wall 134, the locking part 192 is about to be moved over the outer wall 134. However, the base end E' about which the arm part 191 is bent is a distance H' higher than a first contact position D' where the locking part 192 firstly abuts on the outer wall 134. Therefore, a force acts on the first contact position D' of the locking part 192 in a counterclockwise direction shown in an arrow F', namely, a direction opposite to a moving direction of the locking part 192. Therefore, in reality, even when the connector housings 104, 103 are in the middle of engaging with each other, an operator may feel that the engagement is finished and may stop moving the connector housings 104, 103 close to each other. Therefore, there is a fear that the connector housings 104, 103 are half-engaged with each other.

Accordingly, an object of the present invention is to provide a connector which can be small-sized by means of reducing a size in a locking arm bending direction, and which allows an operator to surely engage connectors.

SUMMARY OF THE INVENTION

In order to attain the object, according to the present invention, there is provided a connector including:

a first connector housing;

a second connector to be engaged with the first connector housing;

a locking arm formed on an outer wall of any one of the first and second connector housings; and a locking arm receiver formed vertically on an outer wall of the other connector housing, wherein when the locking arm is locked on the locking arm receiver, the engagement of the first and second connector housings is maintained, wherein the locking arm includes: an arm part extending vertically from the outer wall of the one connector housing and extending in an engaging direction of the first and second connector housings; and a locking part projecting laterally from the tip of the arm part in an extending direction of the arm part, and wherein when the first and second connector housings are engaged with each other, the locking part is moved over and locked on the locking arm receiver, and positioned on a side of the locking arm receiver.

Preferably, when the first and second connector housings are engaged with each other, the arm part of the locking arm is bent about a base end thereof, and the locking part of the locking arm is moved over a rib and locked on the locking arm receiver. Further, when the locking part of the locking arm is moved over the rib, a first contact position where the locking part firstly abuts on the rib is positioned outer than the base end in a bending direction of the arm part.

These and other objects, features, and advantages of the present invention will become more apparent upon reading of the following detailed description along with the accompanied drawings.

DETAILED DESCRIPTION OF THE PREFERRED EMBODIMENTS

Figure 1:
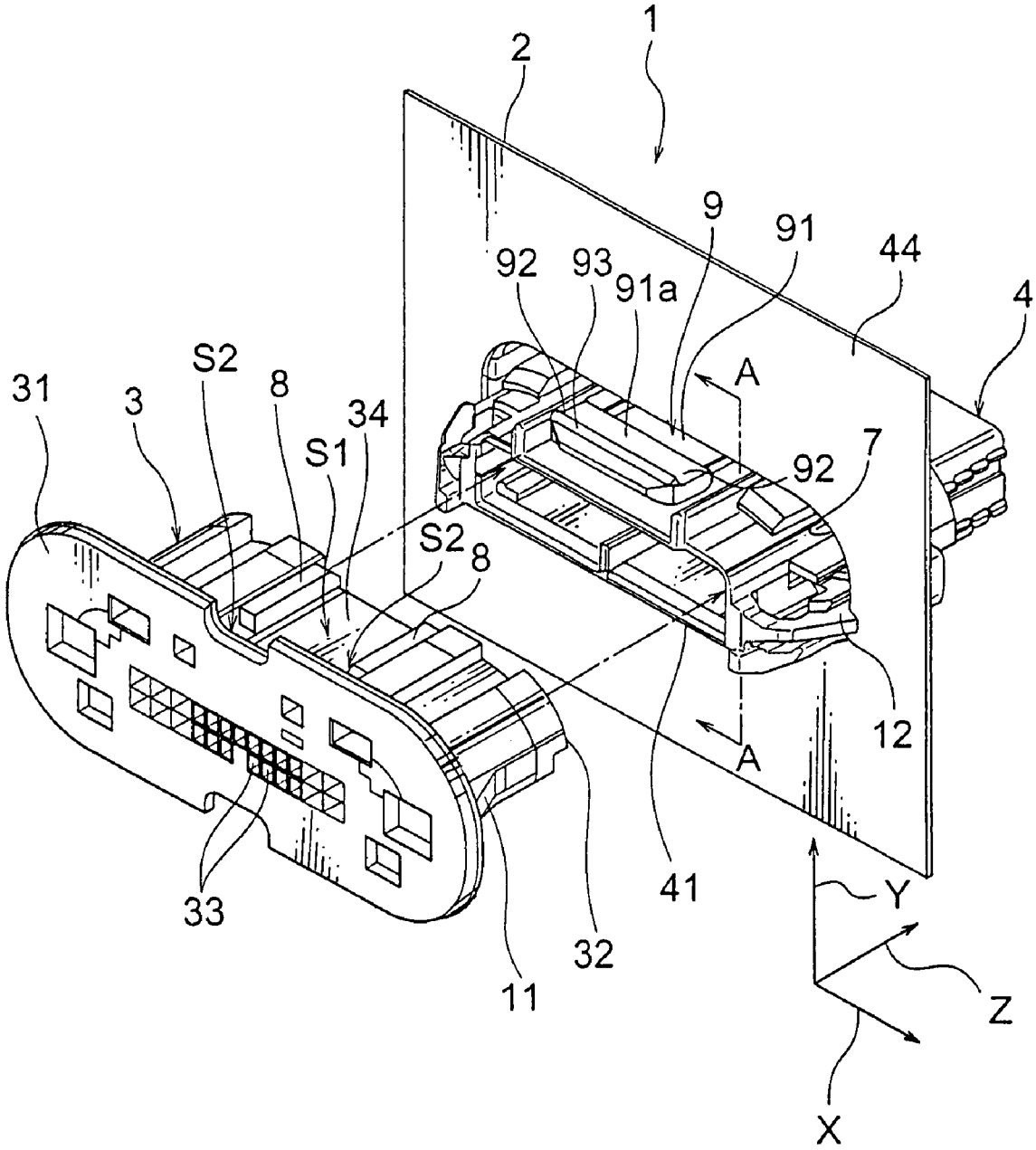
FIG. 1 is a perspective view showing a connector having first and second connector housings according to an embodiment of the present invention, and showing a state that the first connector housing is temporarily locked on a panel.

A connector 1 according to an embodiment of the present invention will be explained with reference to FIGS. 1 to 13. The connector 1 shown in FIG. 1 is a component of a wiring harness for use in a vehicle. As shown in FIG. 1, the connector 1 includes a first connector housing 4, a second connector housing 3, and a grommet 10 (only shown in FIG. 12) attached to the second connector housing 3. The first connector housing 4 and the second connector housing 3 are engaged with each other while a body panel (hereafter referred to as panel) as a component of a vehicle body is interposed between the first and second connector housings 4, 3.

Figure 2:
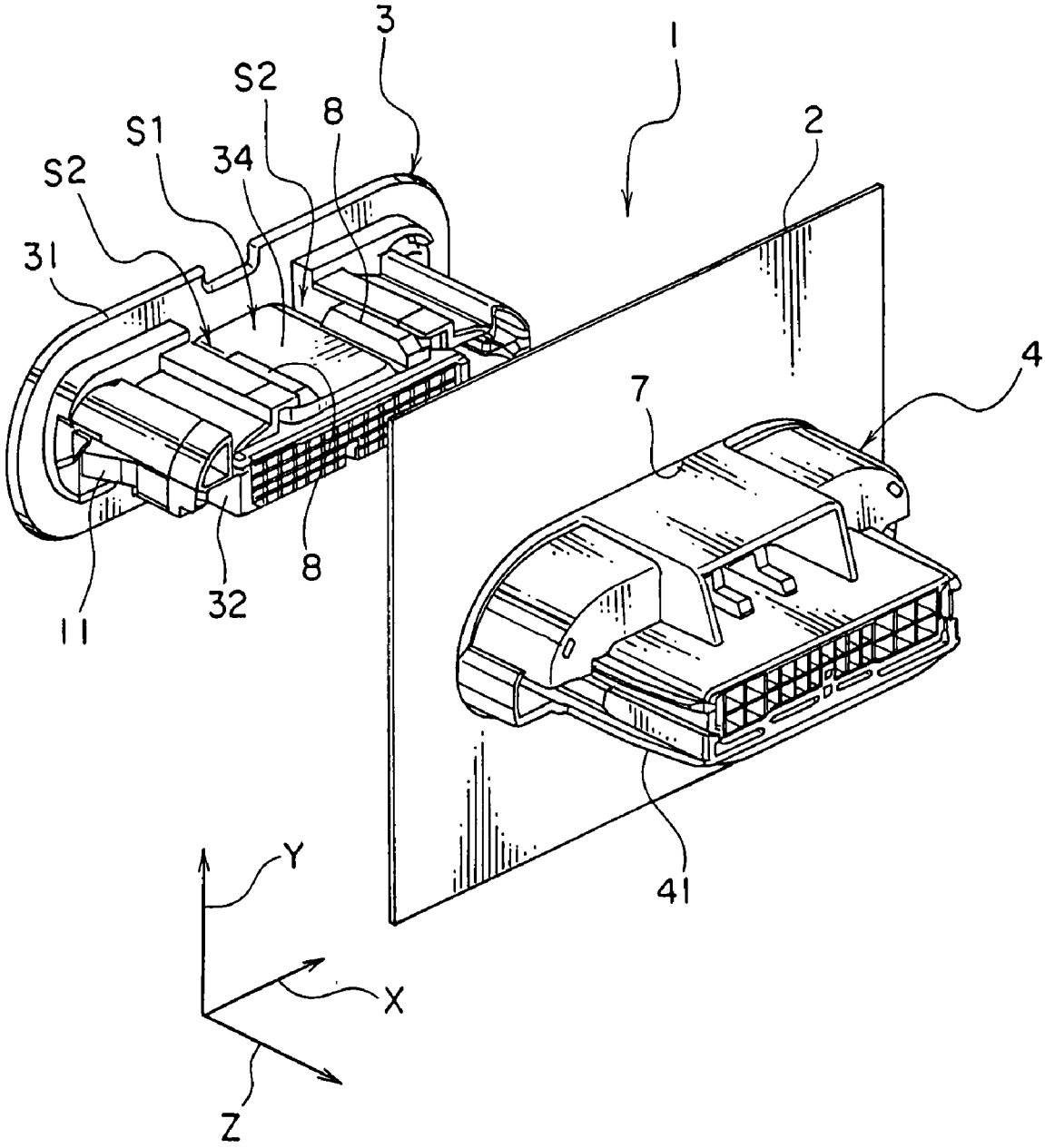
FIG. 2 is a perspective view showing the connector shown in FIG. 1 from a different view point.
Figure 3:
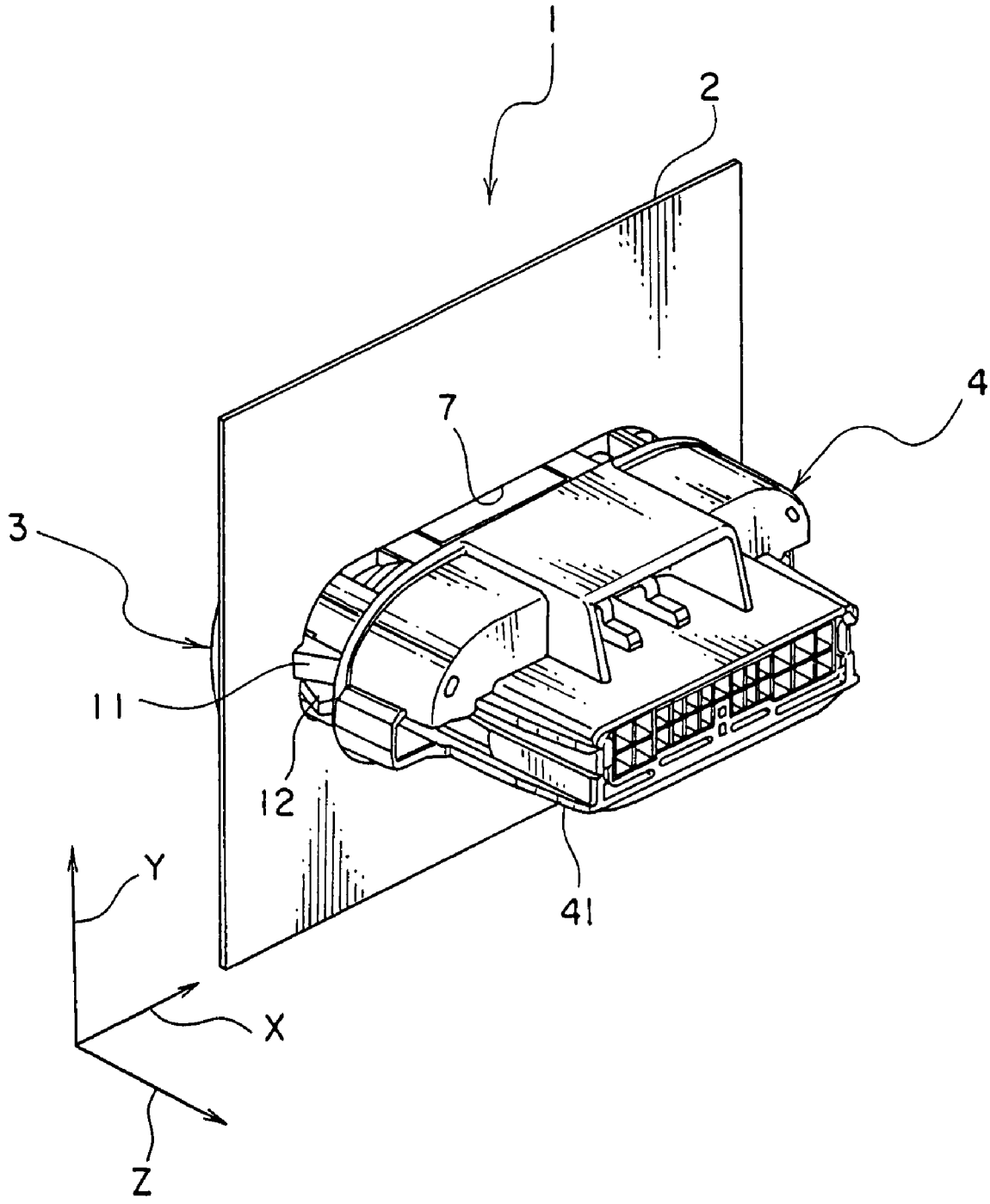
FIG. 3 is a perspective view showing a state that the first and second connector housings shown in FIG. 2 are engaged with each other and permanently locked on the panel.

As shown in FIGS. 1 to 3, a through hole 7 penetrating through the panel 2 is provided on the panel 2. The first connector housing 2 and the second connector housing 3 are engaged with each other through the through hole 7 of the panel 2 while the panel 2 is interposed between the first and second connector housings 4, 3. Simultaneously, the first and second connector housings 4, 3 are fixed on the panel 2.

The first connector housing 4 is made of synthetic resin and includes a main body 41, a pair of temporarily locking parts 12, and a locking arm 9.

The main body 41 is formed in a tubular shape, and includes a plurality of terminal receiving chambers 43 for receiving male type terminal fittings 6 (hereafter referred to as male terminals 6). Each terminal receiving chamber 43 is formed straight and arranged parallel to each other. Further, when the first and second connector housings 2, 3 are engaged with each other, a main body 32 of the second connector housing 3 is inserted into an inside of the main body 41, and the male terminals 6 are inserted into insides of female terminals 5 received in the second connector housing 3. Then, the male terminals 6 and the female terminals 5 are electrically connected to each other.

In this description, a direction where the first and second connector housings 2, 3 are engaged with each other is referred to as "engaging direction", and indicated by an arrow Z. Further, a vertical direction in FIG. 1 of two directions in a plane parallel to the panel 2 and perpendicular to the engaging direction Z is referred to as "height direction" and indicated by an arrow Y. Further, a size of the first connector housing 4 in the height direction Y in a state that the first connector housing 4 is attached to the panel 2 is referred to as "a size in the height direction Y". Further, a direction perpendicular to both the engaging direction Z and the height direction Y is referred to as "width direction" and indicated by an arrow X.

Figure 4:
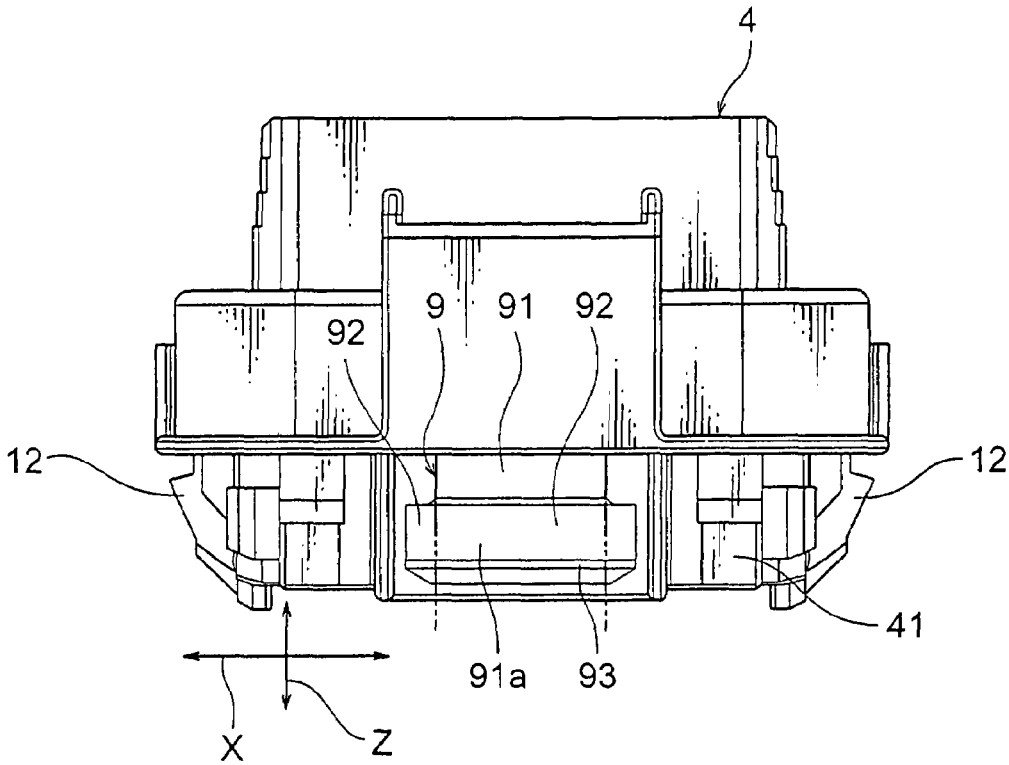
FIG. 4 is a top plan view showing the first connector housing shown in FIG. 1 in a height direction Y.

As shown in FIGS. 1 and 4, the pair of temporarily locking parts 12 are formed on an outer wall of the main body 41 and arranged opposite to each other in the width direction X. Further, the pair of temporarily locking parts 12 are projections projected toward an outside of the first connector housing 4 in the width direction X from the outer walls of the first connector housing 4, and elastically deformable in the width direction X. The pair of temporarily locking parts 12 abut on an inner edge of the through hole 7 of the panel 2, and press the panel 2 for expanding the through hole 7 so that the first connector housing 4 is temporarily locked on the panel 2. As the main body 32 of the second connector housing 3 is inserted into an inside of the main body 41 of the first connector housing 4, the pair of temporarily locking parts 12 is pushed by the main body 32 and elastically deformed toward the inside of the main body 41. Then, when the pair of temporarily locking parts 12 is elastically deformed toward the inside of the main body 41, the temporary lock of the first connector housing 4 on the panel 2 is released, and the first connector housing 4 becomes movable relative to the panel 2.

Figure 5:
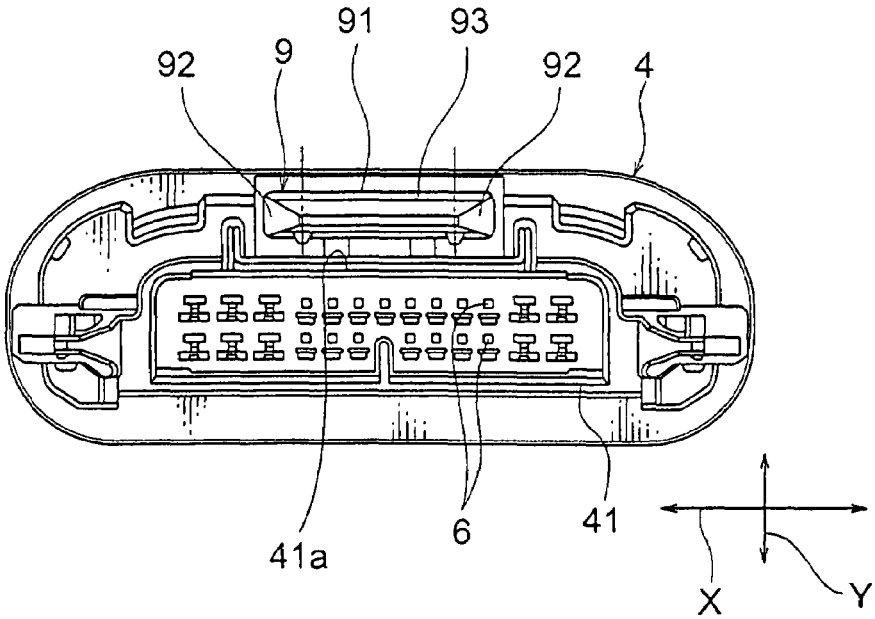
FIG. 5 is a front view showing the first connector housing shown in FIG. 1 in an engaging direction Z.
Figure 8:
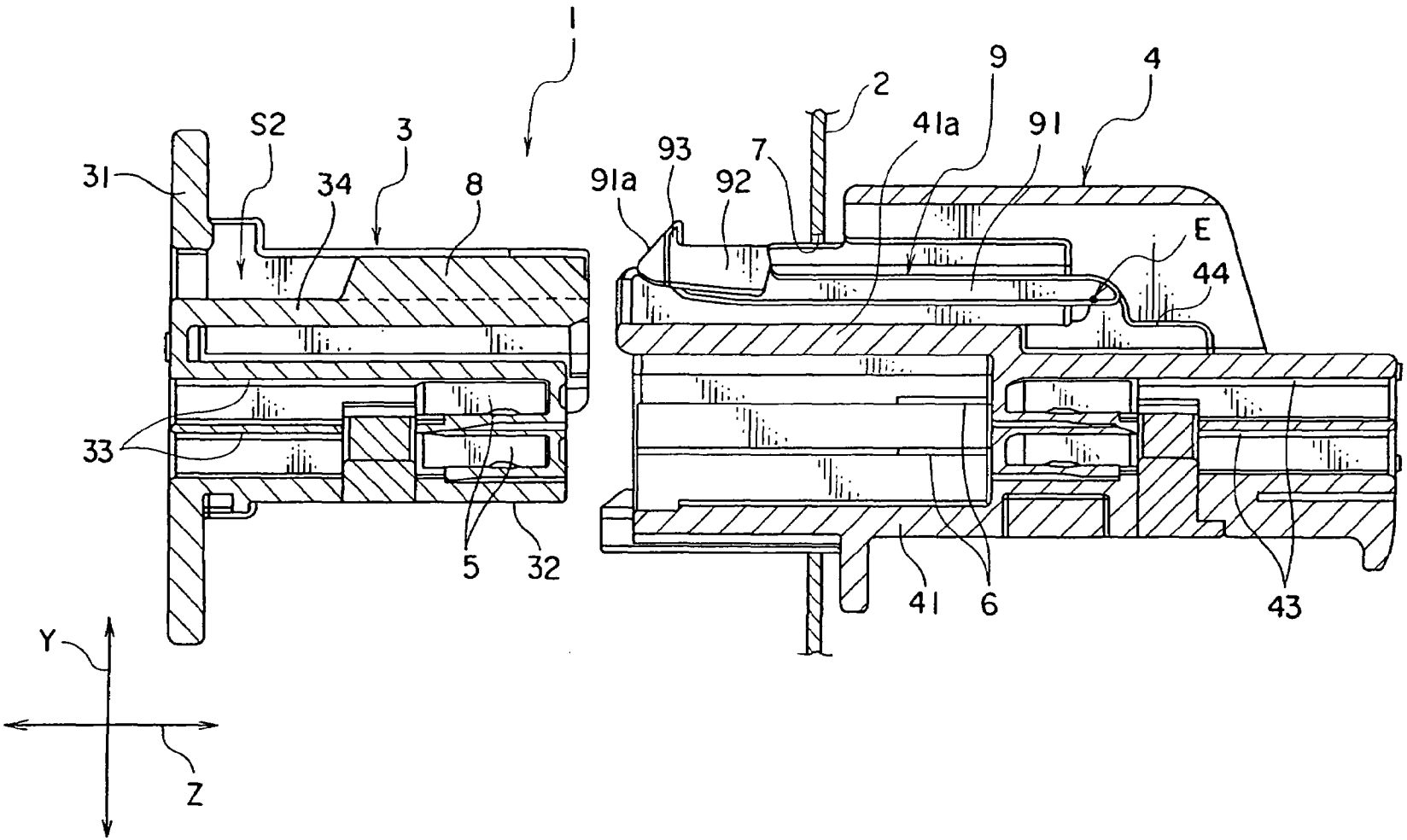
FIG. 8 is a sectional view taken on line A-A in FIG. 1.

The locking arm 9 is extended from an upper wall 44 which is one of outer walls of the main body 41, and disposed on an upper side of FIG. 8. The locking arm 9 includes a plate-shaped arm part 91 extending toward a side where the second connector housing 3 is engaged in the engaging direction Z, a pair of locking parts 92 projecting perpendicular to the engaging direction Z along a plane parallel to the upper wall 44 (namely, parallel to a later-described second hood 34) from a tip 91*a* of the arm part 91, and a projecting part 93 projecting toward an outside of the main body 41 in the height direction Y from a tip 91*a* of the arm part 91. Namely, as shown in FIGS. 4 and 5, the pair of locking parts 92 are projections projected outward in the width direction X from both ends of the arm part 91 in the width direction X. The pair of locking parts 92 is positioned outside of chain double-dashed lines shown in FIGS. 4 and 5. Further, a size of the tip 91*a* of the arm part 91 in the height direction Y is substantially the same as sizes of the pair of locking parts 92 in the height direction Y.

Figure 11:
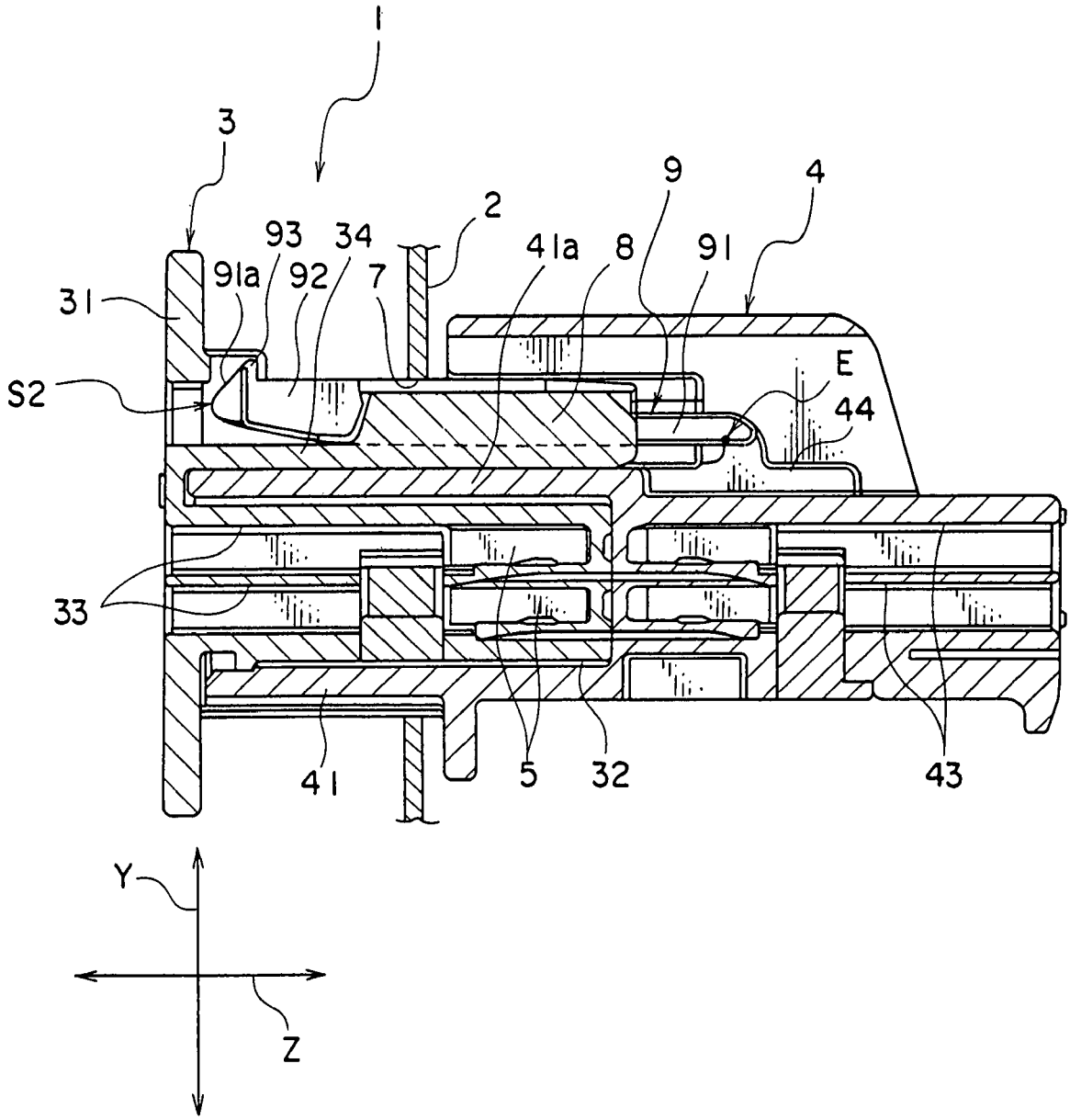
FIG. 11 is a sectional view showing a state that the second connector housing shown in FIG. 10 is engaged with the first connector housing.

As shown in FIG. 8, the arm part 91 is elastically deformable about a base end E extending from the upper wall 44 in the height direction Y. "An outside in a bending direction of the arm part" in this description means an outside of the main body 41 in the height direction Y, namely, a bending direction apart from the upper wall 44. As shown in FIG. 11, the arm part 91 is separated from both the upper wall 44 and a first hood 41*a*. The later-described second hood 34 of the second connector housing 3 is interposed between the arm part 91 and the first hood 41*a*. Here, the first hood 41*a* is one of the outer walls of the main body 41, arranged in the same plane as the upper wall 44, and disposed nearer an engaging side than the upper wall 44.

Figure 10:
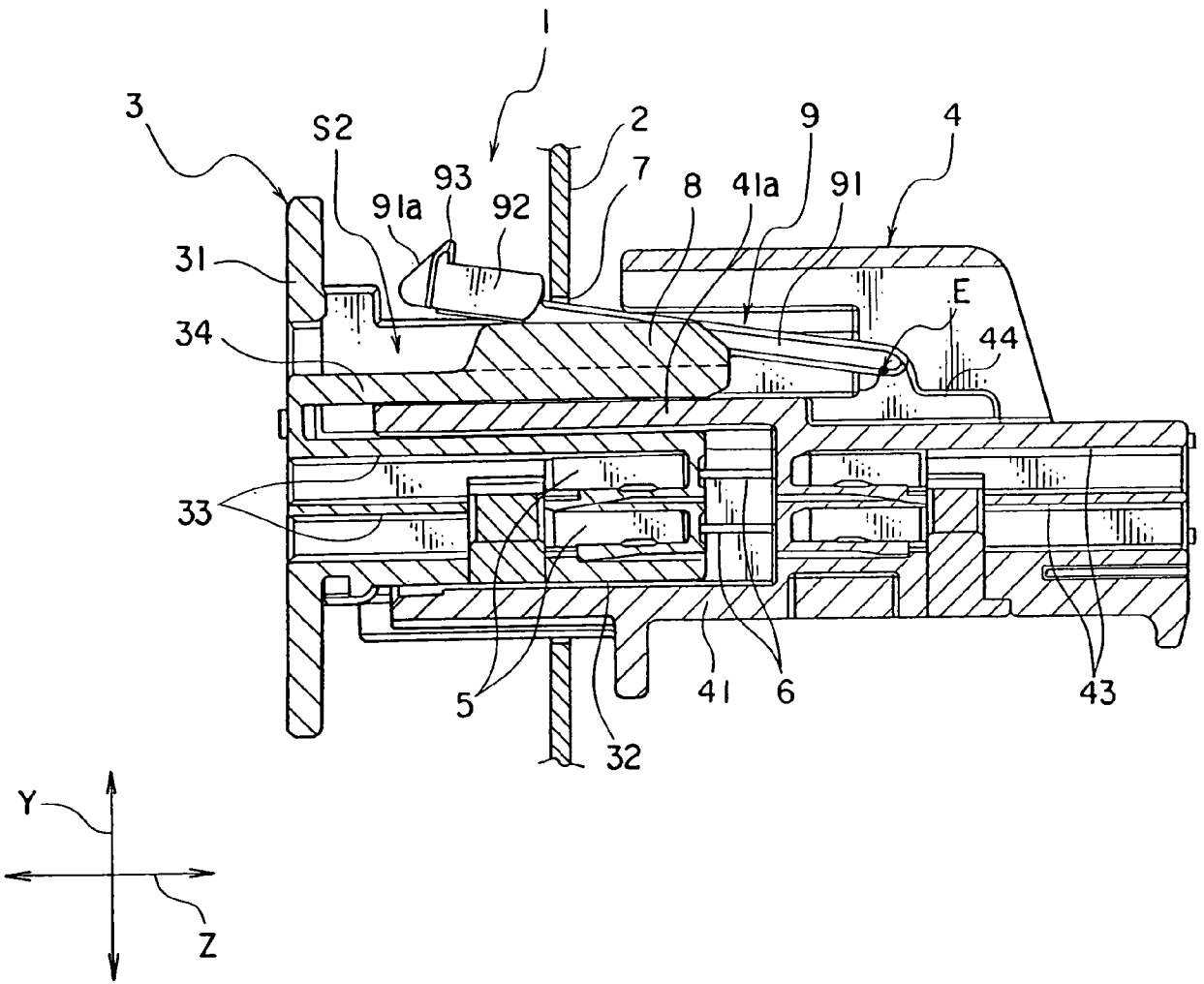
FIG. 10 is a sectional view showing a state that the second connector housing shown in FIG. 9 is moved close to and nearly engaged with the first connector housing.

As shown in FIG. 10, when the first connector housing 4 is engaged with the second connector housing 3 while the first connector housing 4 is temporarily locked on the panel 2, the pair of locking parts 92 is moved over later-described ribs 8 so that the projecting part 93 is elastically deformed outside, and positioned at an outside of the through hole 7 of the panel 2. Thus, the projecting part 93 prevents the first connector housing 4, of which temporary lock is released, from falling out of the panel 2.

The second connector housing 3 is made of synthetic resin, and includes a main body 32, a flange 31, a pair of permanent locking parts 11, the second hood 34 as the other outer wall, and a pair of ribs 8 as locking arm receivers.

The main body 32 is formed in a box shape, and includes a plurality of terminal receiving chambers 33 for receiving female-type terminal fittings 5 (hereafter referred to as female terminals 5). Further, when the first and second connector housings 4, 3 are engaged with each other, the main body 32 is inserted into an inside of the first connector housing 4 in a longitudinal direction of the female terminals 5.

Figure 12:
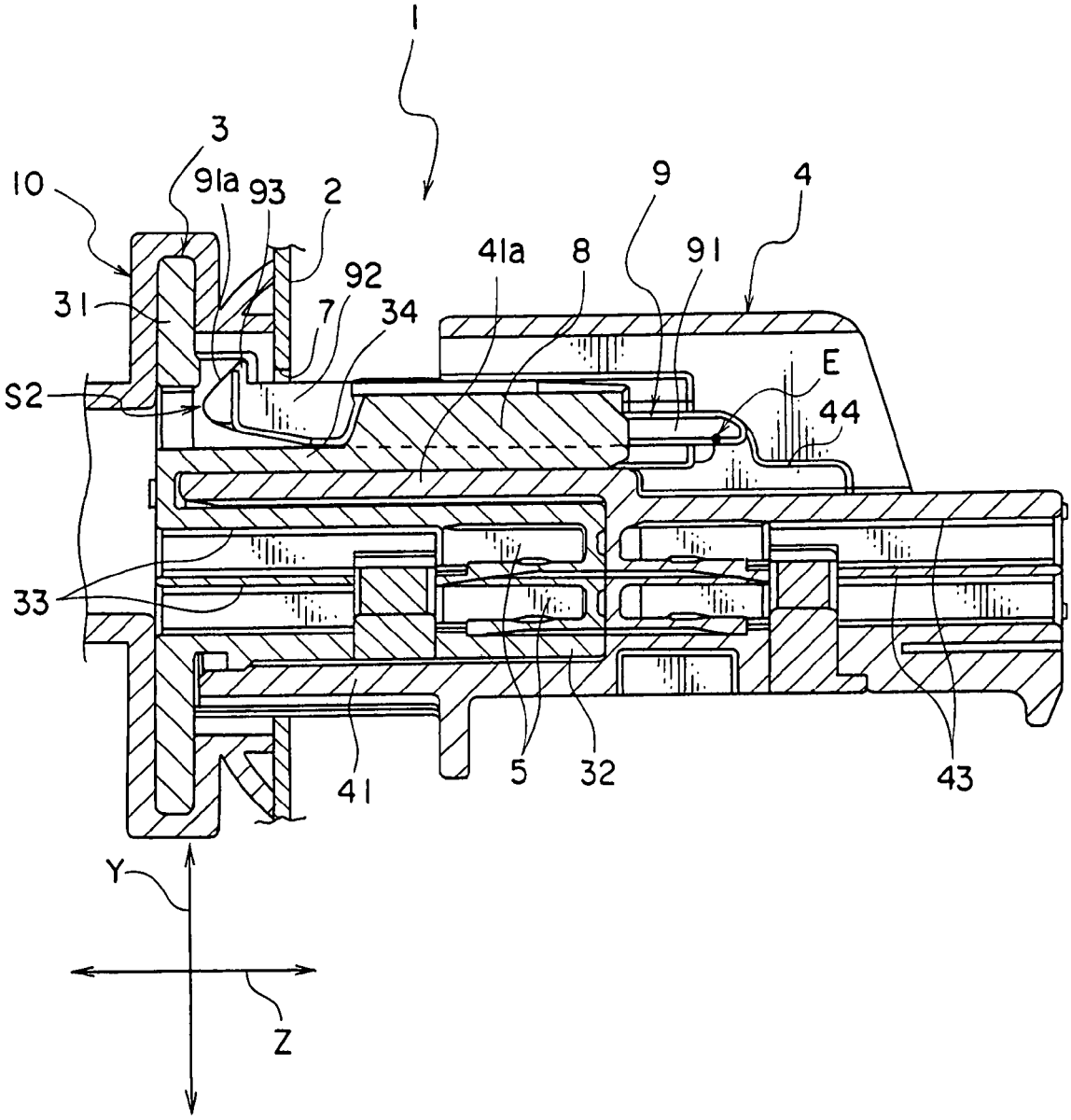
FIG. 12 is a sectional view showing a state that the connector shown in FIG. 10 is permanently locked on the panel.

The flange 31 is extended perpendicular to the longitudinal direction of the female terminals 5 and extended from an edge of the main body 32 further from the first connector housing 4. The grommet 10 is attached to the second connector housing 3 for covering the flange 31. As shown in FIG. 12, when the first and second connector housings 4, 3 are engaged with each other, namely, when the connector 1 is permanently locked on the panel 2, the grommet 10 is attached firmly to an outside of the through hole 7 to prevent liquid or the like from entering an inside of the connector 1.

Figure 6:
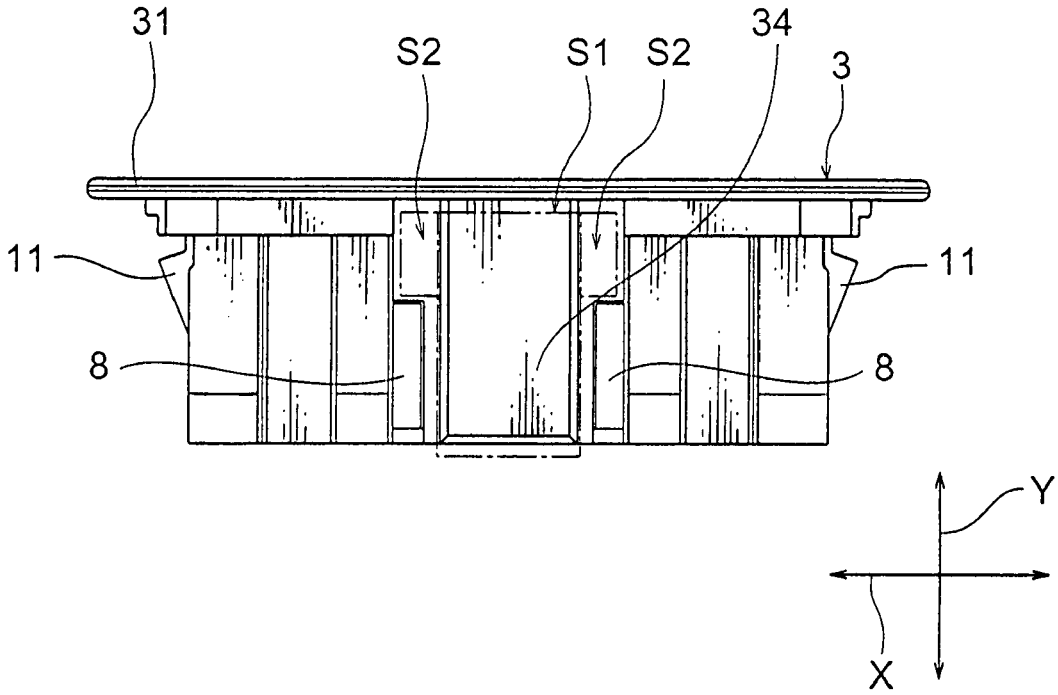
FIG. 6 is a top plan view showing the second connector housing shown in FIG. 1 in a height direction Y.

As shown in FIGS. 1 and 6, the pair of permanent locking parts 11 is formed opposite to each other in the width direction X on the outer wall of the main body 32 when the second connector housing 3 is engaged with the first connector housing 4, and projected outside of the second connector housing 3 from the surface of the outer wall in the width direction X.

When the first and second connector housings 4, 3 engaged with each other is slid in the engaging direction Z and positioned at a permanent locking position shown in FIGS. 3 and 12, the pair of permanent locking parts 11 abuts on an inner edge of the through hole 7 of the panel 2, and presses the panel 2 to enlarge the through hole 7, so that the first and second connector housings 4, 3, namely, the connector 1 is permanently locked on the panel 2.

Figure 7:
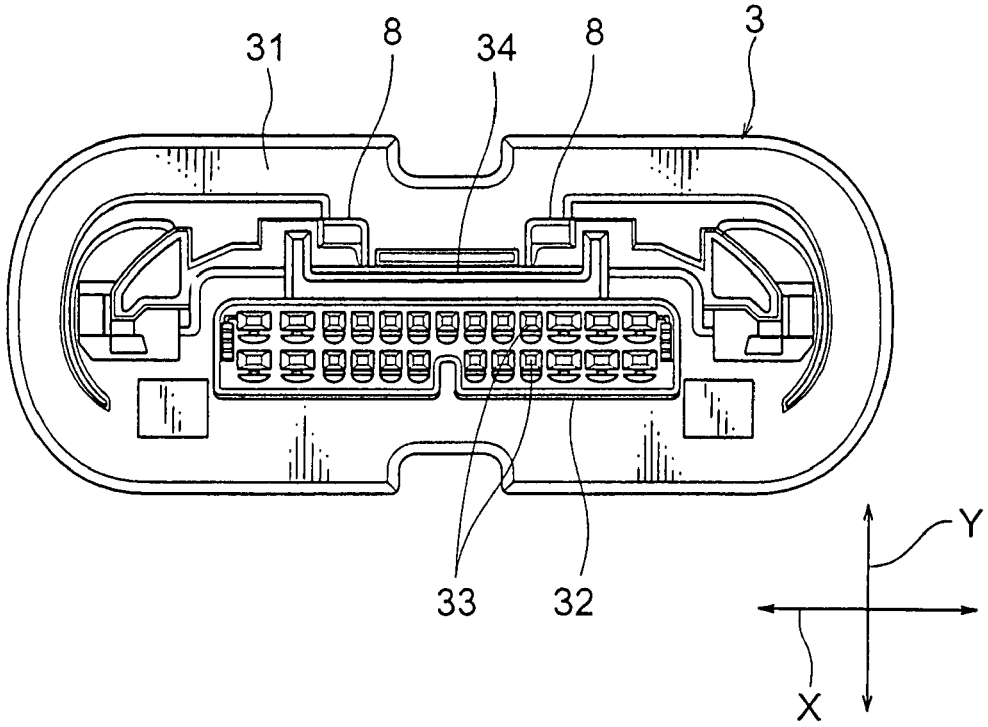
FIG. 7 is a front view showing the second connector housing shown in FIG. 1 in an engaging direction Z.

As shown in FIGS. 7 and 8, the second hood 34 is an outer wall facing the outer wall of the main body 32 in the height direction Y. As described above, when the first and second connector housings 4, 3 are engaged with each other, the second hood 34 is interposed between the arm part 91 and the first hood 41*a*, and the first hood 41*a* is interposed between the main body 32 and the second hood 34.

The pair of ribs 8 are projected outside of the second connector housing 3 in the height direction Y from the outer surface of the second hood 34, and extended in the engaging direction Z, namely, the longitudinal direction of the female terminals 5. A height of the pair of ribs 8 in the height direction Y is substantially the same as a thickness of the tip 91*a* of the arm part 91. As shown in FIG. 6, the pair of ribs 8 is separated from each other in the width direction X, and the arm part 91 is positioned in a space S1 (indicated by alternate long and short dashed lines in FIG. 6) formed between the pair of ribs 8. Further, the pair of ribs 8 is respectively separated from the flange 31, and the pair of locking parts 92 is positioned in a space S2 (indicated by alternate long and short dashed lines in FIG. 6) formed between the pair of ribs 8 and the flange 31. Namely, as shown in FIG. 11, when the first and second connector housings 4, 3 are engaged with each other, the pair of ribs 8 is positioned nearer the base end E of the arm part 91 than the pair of locking parts 92, and respectively abuts on the pair of locking parts 92 to be locked on the locking arm 9. Then, because the pair of ribs 8 is locked on the locking arm 9, the first and second connector housings 4, 3 engaged with each other are prevented from being displaced in the engaging direction Z, and the engagement state of the first and second connector housings 4, 3 is maintained.

Figure 9:
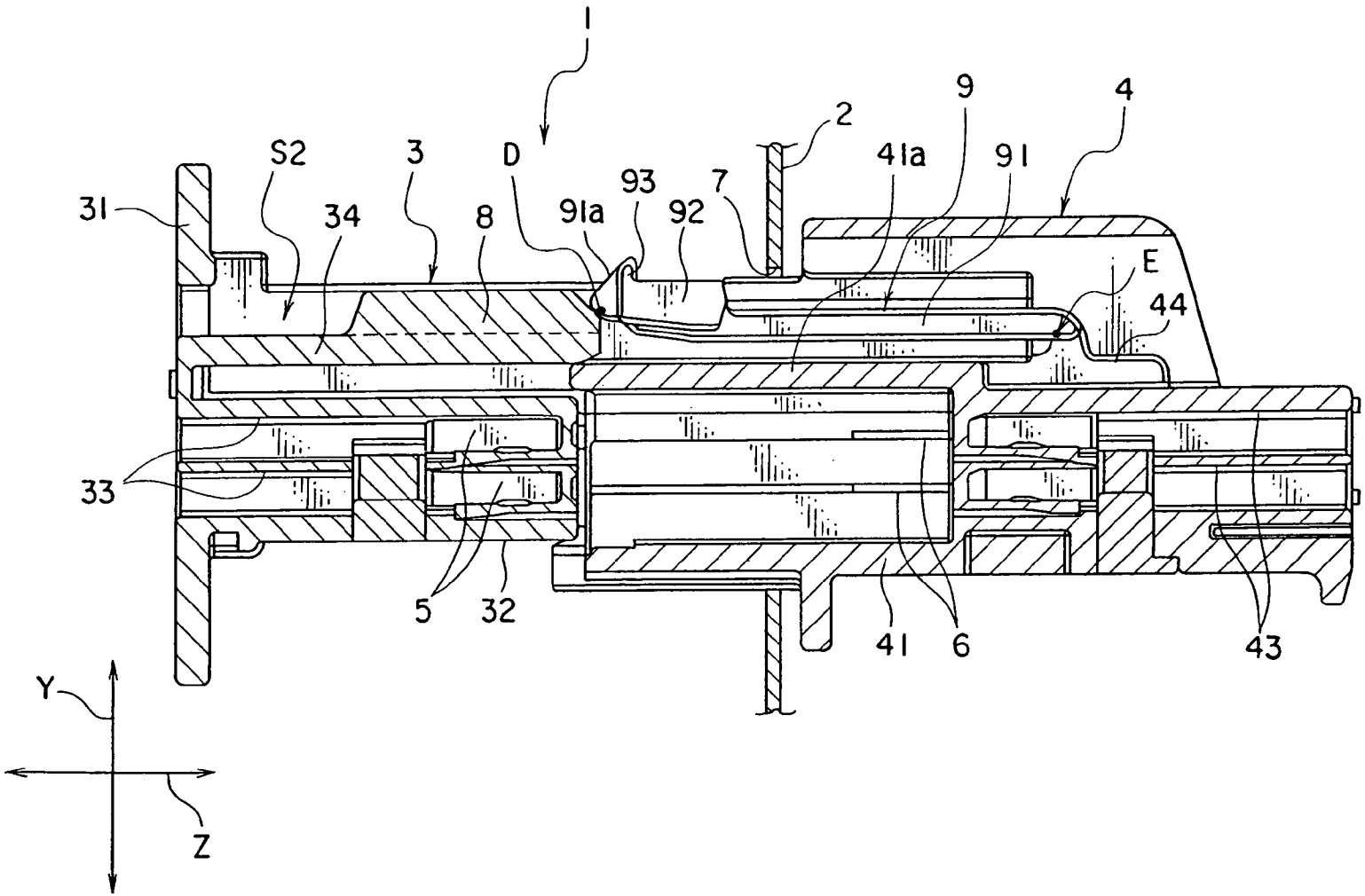
FIG. 9 is a sectional view showing a state that the second connector housing shown in FIG. 8 is moved close to the first connector housing.
Figure 13:
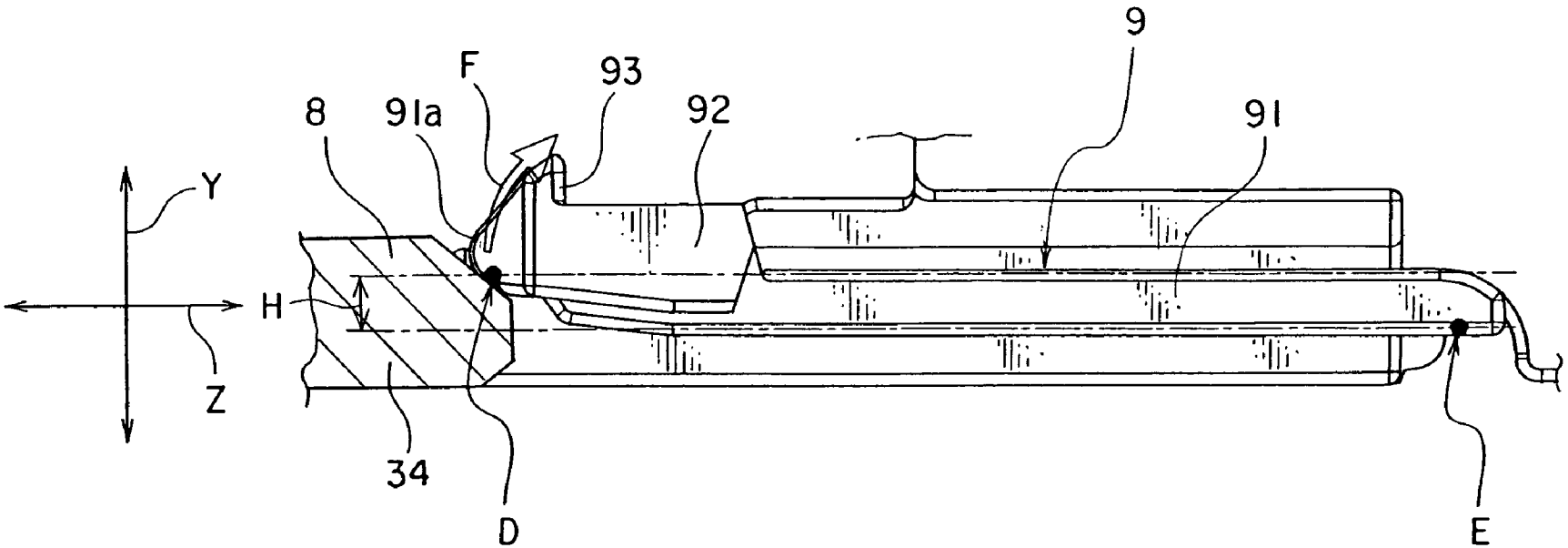
FIG. 13 is an enlarged view showing a pain part of the connector shown in FIG. 9.
Figure 14:
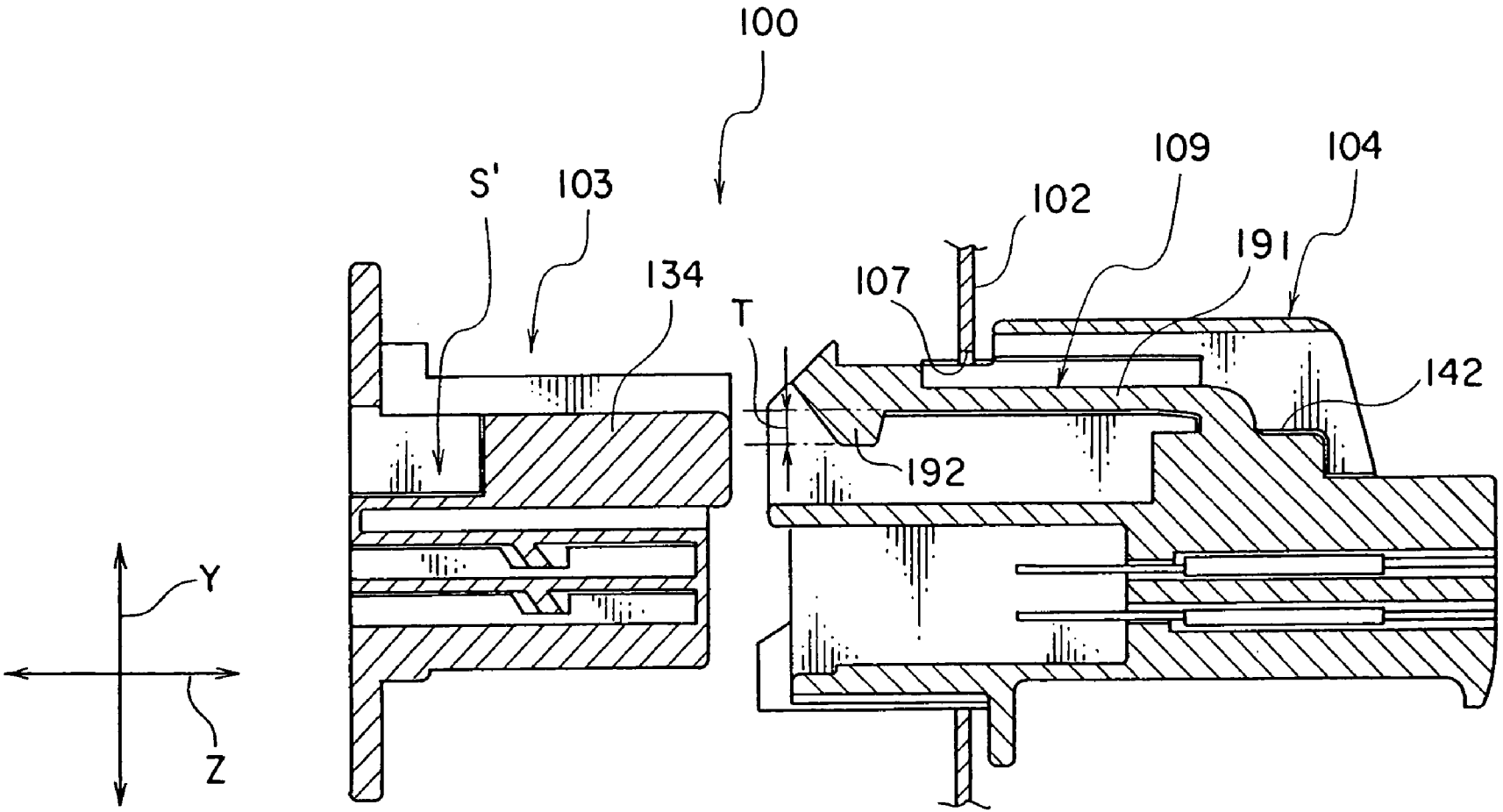
FIG. 14 PRIOR ART
FIG. 14 is a sectional view showing a conventional connector having a first conventional connector housing and a second conventional connector housing.
Figure 15:
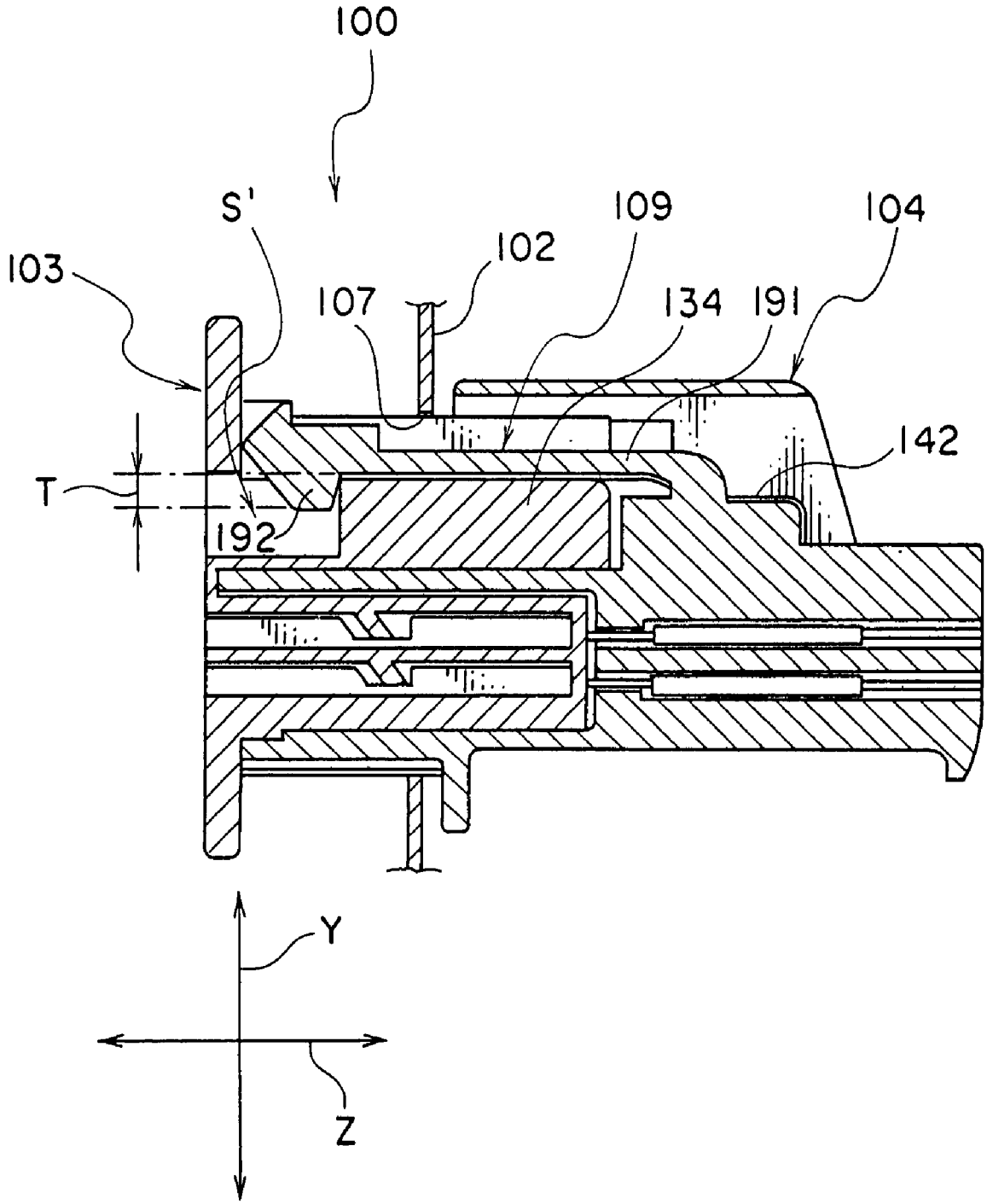
FIG. 15 PRIOR ART
FIG. 15 is a sectional view showing a state that the second conventional connector housing is engaged with the first conventional connector housing.
Figure 16:
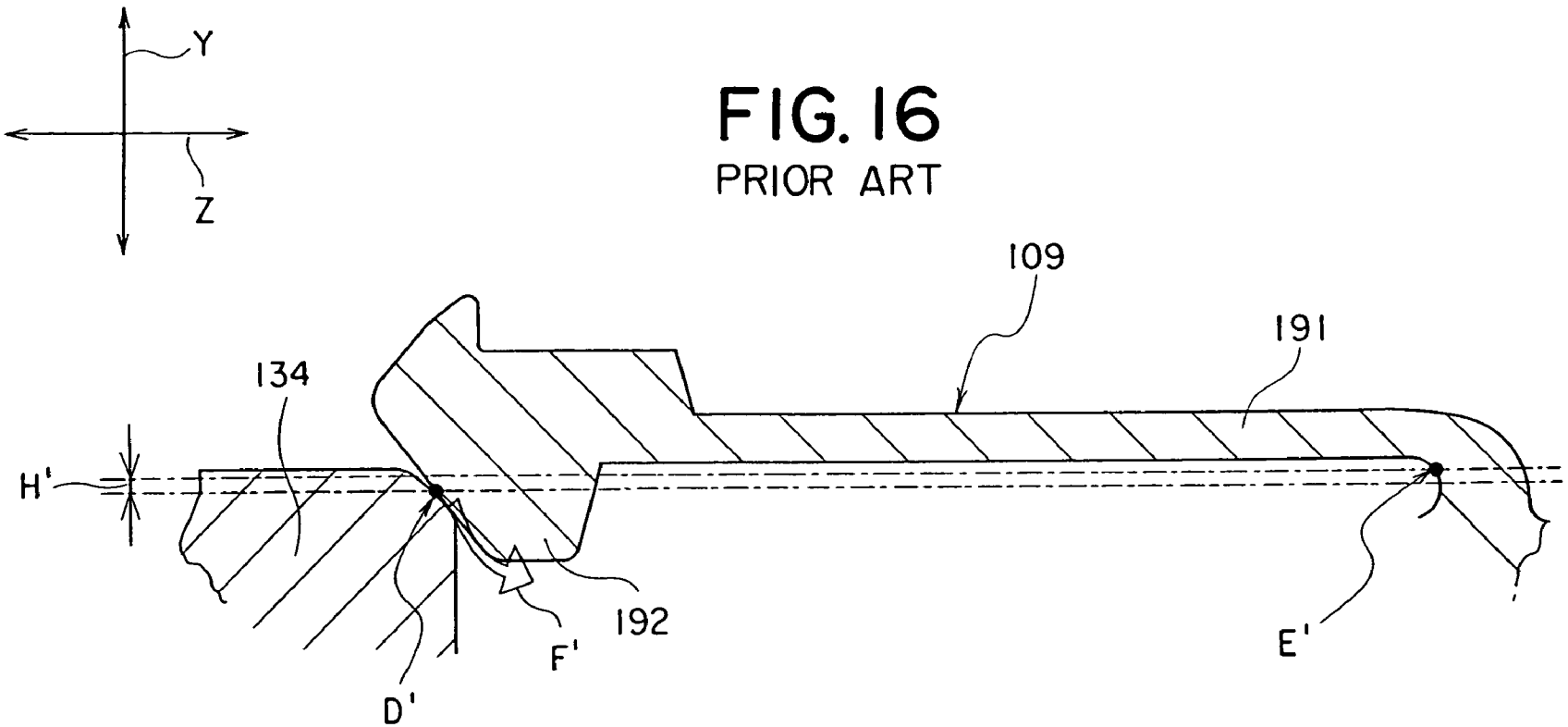
FIG. 16 PRIOR ART
FIG. 16 is an enlarged sectional view for explaining a problem of the conventional connector shown in FIG. 14, and showing a state that the locking part of the first conventional connector housing abuts on an outer wall of the second conventional connector housing.

As shown in FIGS. 9 and 13, when the first and second connector housings 4, 3 are moved close to each other in the engaging direction Z, the pair of locking parts 92 respectively abuts on the pair of ribs 8. As shown in FIG. 10, then when the first and second connector housings 4, 3 are moved further close to each other in the engaging direction Z, the arm part 91 is bent about the base end E toward the outside of the first connector housing 4, and the pair of locking parts 92 is respectively moved on the pair of ribs 8. Then, when the first and second connector housings 4, 3 are moved further close to each other in the engaging direction Z, the first and second connector housings 4, 3 are engaged with each other. Simultaneously, the pair of locking parts 92 respectively falls down to the space S2, and the pair of ribs 8 is locked on the locking arm 9.

As shown in FIG. 13, the locking arm 9 is so formed that when the pair of locking parts 92 is moved over the pair of ribs 8, a pair of first contact positions D of the pair of locking parts 92 on the pair of ribs 8 is a distance H outer (higher) than the base end E in a bending direction of the arm part 91 (namely, the height direction Y). Therefore, when the pair of locking parts 92 abuts on the pair of ribs 8 and is about to moved over the pair of ribs 8, a force acts on the first contact positions D in a clockwise direction indicated by an arrow F, namely, in a direction of moving over the pair of ribs 8. Therefore, the pair of locking parts 92 is smoothly moved over the pair of ribs 8.

When the connector 1 having the above described structure is assembled, firstly, as shown in FIGS. 1 and 8, the pair of temporarily locking parts 12 abuts on the inner edge of the through hole 7 of the panel 2 to temporarily attach the first connector housing 4 to the panel 2. Namely, the first connector housing 4 is temporarily locked on the panel 2. Then, as shown in FIG. 9, the second connector housing 3 is moved close to the first connector housing 4, and the main body 32 of the second connector housing 3 is inserted into the inside of the main body 41 of the second connector housing 3.

Then, as shown in FIG. 10, the pair of locking parts 92 is moved on the pair of ribs 8, the arm part 91 is elastically deformed outside in the height direction Y, and the projecting part 93 is positioned outside of the through hole 7 of the panel 2. Then, when the main body 32 of the second connector housing 3 is further inserted into the inside of the main body 41 of the first connector housing 4, as described above, the main body 32 presses the pair of temporarily locking parts 12 to elastically deform the pair of temporarily locking parts 12 toward an inside of the main body 41, and the temporary lock of the first connector housing 4 on the panel 2 is released. Further, after the temporary lock of the first connector housing 4 on the panel 2 is released, because the projecting part 93 is positioned outside of the through hole 7 of the panel 2, the projecting part 93 prevents the first connector housing 4 from falling out of the panel 2 until the second connector housing 3 is fully engaged with the first connector housing 4.

Then, from this state, when the 32 of the second connector housing 3 is inserted into the inside of the main body 41 of the first connector housing 4, the pair of locking parts 92 is moved over the pair of ribs 8 and falls down to the space S2, namely, the arm part 91 elastically deformed outside is elastically restored to an initial position. Then, as shown in FIG. 11, when the pair of ribs 8 is locked on the locking arm 9, simultaneously, the first and second connector housings 4, 3 are engaged with each other. Then, when the second connector housing 3 is pushed toward the panel 2, the first and second connector housings 4, 3 engaged with each other, namely, the connector 1 is slid in the engaging direction Z, and the pair of permanent locking parts 11 abuts on the inner edge of the panel 2. Thus, as shown in FIGS. 3 and 12, the connector 1 is permanently locked on the panel 2.

As described the above, according to the present invention, the pair of locking parts 92 is projected in the width direction X from both ends of the arm part 91 in the width direction X. Further, the pair of locking parts 92 is respectively positioned in the spaces S2 respectively formed between the flange 31 and the pair of ribs 8 of which height is substantially the same as the thickness of the tip 91*a* of the arm part 91 so that the pair of ribs 8 is locked on the locking arm 9. Therefore, a size in the height direction Y of a locking structure (namely, the locking arm 9 and the pair of ribs 8) for maintaining the engagement of the first and second connector housings 4, 3 is composed of only a thickness of the arm part 91. Therefore, the size in the height direction Y of the connector 1 can be reduced.

Further, as described the above, according to the present invention, the pair of locking parts 92 is projected in the width direction X of the arm part 91. Further, the first contact position D of the pair of locking parts 92 to the pair of ribs 8 when the pair of locking parts 92 is moved over the pair of ribs 8 is the distance H higher than the base end E in the bending direction of the arm part 91 (namely, the height direction Y). Therefore, the pair of locking parts 92 is smoothly moved on the pair of ribs 8. Therefore, the operator may not feel that the engagement is finished when the first and second connector housings 3, 4 are in the middle of engaging as the conventional connector. Therefore, the first and second connector housings 4, 3 are surely prevented from being half-engaged with each other, namely, the first and second connector housings 4, 3 can be surely fully engaged with each other.

Further, according to this embodiment, because the locking parts 92 and the ribs 8 are respectively formed as pairs, and arranged in the width direction X, when the first and second connector housings 4, 3 are engaged with each other, the arm part 91 is interposed between the pair of ribs 8. Therefore, the locking arm 9 and the pair of ribs 8 are prevented from rattling.

Further, according to this embodiment, the locking arm 9 includes the locking arm 9, and the locking arm receiver includes the pair of ribs 8. However, according to the present invention, the locking arm 9 may include at least one locking part 92, and the locking arm receiving member may include at least one rib 8.

Further, according to this embodiment, the connector 1 is attached to the body panel 2 as a component of the vehicle body. However, according to the present invention, the connector 1 may be attached to various panels other than the body panel 2 of the vehicle body. Further, according to the present invention, the connector 1 may not be attached to the panel. The connector 1 may at least include the locking arm 9 and the locking arm receiver.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A connector comprising:

a first connector housing;

a second connector to be engaged with the first connector housing;

a locking arm formed on an outer wall of any one of the first and second connector housings; and a locking arm receiver formed vertically on an outer wall of the other connector housing, wherein when the locking arm is locked on the locking arm receiver, the engagement of the first and second connector housings is maintained, wherein the locking arm includes: an arm part extending vertically from the outer wall of the one connector housing and extending in an engaging direction of the first and second connector housings; and a locking part projecting laterally from the tip of the arm part in an extending direction of the arm part, wherein when the first and second connector housings are engaged with each other, the locking part is moved over and locked on the locking arm receiver, and positioned on a side of the locking arm receiver, wherein when the first and second connector housings are engaged with each other, the arm part of the locking arm is bent about a base end thereof, and the locking part of the locking arm is moved over a rib and locked on the locking arm receiver, and wherein when the locking part of the locking arm is moved over the rib, a first contact position where the locking part firstly abuts on the rib is positioned higher than the base end in a bending direction of the arm part.

* * * * *